US006516875B2

(12) United States Patent
Reilly et al.

(10) Patent No.: US 6,516,875 B2
(45) Date of Patent: Feb. 11, 2003

(54) TUBING HANGER LOCKDOWN MECHANISM

(75) Inventors: Gavin T. Reilly, Blackwood (GB); Richard Kent, Newburgh (GB); Alasdair MacFarlane, Head of Muir (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/905,588

(22) Filed: Jul. 13, 2001

(65) Prior Publication Data

US 2002/0062957 A1 May 30, 2002

(51) Int. Cl.[7] ..... E21B 33/04
(52) U.S. Cl. ..... 166/75.14; 166/208; 166/212
(58) Field of Search ..... 166/75.14, 96.1, 166/76.1, 98, 208, 206, 212, 217

(56) References Cited

U.S. PATENT DOCUMENTS 3,603,401 A * 9/1971 Nelson ..... 166/313
3,693,714 A * 9/1972 Baugh ..... 166/85
4,548,273 A * 10/1985 Leicht et al. ..... 166/348
4,597,448 A * 7/1986 Baugh ..... 166/348
4,615,544 A * 10/1986 Baugh ..... 285/18
5,255,746 A 10/1993 Bridges

FOREIGN PATENT DOCUMENTS

GB 2 344 838 A 6/2000

* cited by examiner

*Primary Examiner*—Frank S. Tsay
(74) *Attorney, Agent, or Firm*—Henry C. Query, Jr.

(57) ABSTRACT

A completion component such as a tubing hanger includes a lockdown mechanism with an actuating mandrel that includes a positively acting anti-backout mechanism, which can be remotely deployed. The mechanism comprises a tooth on an inwardly biased retention ring carried by the mandrel, and positively engageable with a corresponding profile on the tubing hanger. Detent pins are outwardly biased by a tubing hanger running tool latch piston to hold the tooth and profile out of engagement during installation of the tubing hanger and setting of the actuating mandrel.

7 Claims, 3 Drawing Sheets

TUBING HANGER LOCKDOWN MECHANISM

BACKGROUND OF THE INVENTION

This invention relates to lockdown mechanisms for completion components in hydrocarbon wells. For simplicity, much of the following discussion refers to tubing hanger lockdown mechanisms, although the invention is of more general applicability.

Tubing hangers and other completion components have a requirement to be rigidly locked into the wellhead, horizontal christmas tree or other receptacle in which they are landed, to ensure safe operating conditions. The tubing hanger is typically provided with an integral lock mechanism which when activated secures the tubing hanger to the wellhead. Any subsequent pressure load below the hanger will then not cause the hanger to rise within the wellbore, which would result in unsafe operating conditions.

Many tubing hanger lock mechanisms utilize an activating mandrel with a 4 degree taper to take account of equipment stack up tolerances. Activating mandrels with 4 degree tapers (or larger) are prone to work loose under certain operating conditions (e.g., vibration, cyclic loading, slug flow, etc.). This can lead to a reduction of the lock mechanism retention capacity, causing an unsafe condition.

Existing methods of retaining the mandrel in the set condition rely on either manual intervention with additional back up equipment (e.g., lockdown bolts in surface equipment), or integral devices that rely on friction contact with the activating mandrel.

SUMMARY OF THE INVENTION

The present invention provides a completion component having a lockdown mechanism comprising:

an actuating mandrel provided with a taper surface;

a locking dog engageable with the taper surface for movement between contracted and expanded positions;

a locking member carried by the actuating mandrel or completion component and having a radially directed locking profile;

a radially directed complementary locking profile being provided on the completion component or actuating mandrel, the locking profile being radially biased into engagement with the complementary locking profile so as to restrain the actuating mandrel against axial movement relative to the completion component; and a running tool latch mechanism engageable with the locking member during installation of the completion component so as to move the locking profile and complementary locking profile out of engagement against said bias, whereby the actuating mandrel is free to move axially of the completion component.

Thus the invention provides a completion component lockdown mechanism with an actuating mandrel that includes a positively acting anti-backout device, which can be remotely deployed.

Preferably the locking profile and complementary locking profile comprise teeth having a positive rake angle such that forces acting on the actuating mandrel in a direction tending to move the locking dog towards the contracted position also cause the locking profile and complementary locking profile to move into tighter engagement.

The locking profile and/or the complementary locking profile may comprise an axially spaced series of teeth, to accommodate completion component stackup tolerances.

The lockdown mechanism may comprise a pin having a first end engageable by a latch piston of the running tool latch mechanism, and a second end arranged to move the locking member against said radial bias when the first end is so engaged. The pin first end may comprise a ball bearing.

The locking member may be a split ring which, for example, is radially inwardly biased and is carried in a groove formed in an axial bore of the actuating mandrel.

Further preferred features of the invention are in the following description of an illustrative embodiment.

DETAILED DESCRIPTION OF THE PREFERRED EMBODIMENTS

The preferred embodiment of the invention comprises a THRT 10 and a tubing hanger 12 having a lockdown mechanism that incorporates a positive anti-backout device. This device has three primary components: 1) a retention ring incorporating a locking profile, 2) a detent pin, and 3) a complementary locking profile on the tubing hanger.

1) Retention Ring

Figure 2:
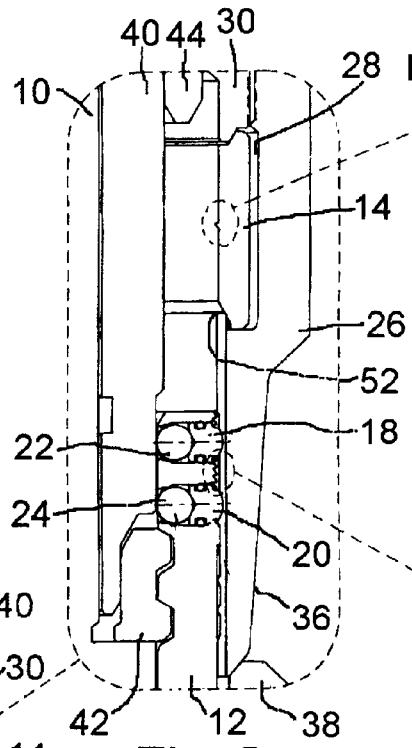
FIG. 2 shows a portion of FIG. 1 on an enlarged scale.
Figure 2A:
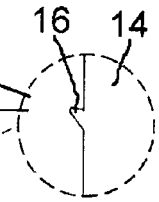
FIGS. 2*a* and 2*b* show portions of FIG. 2 on an enlarged scale.
Figure 2B:
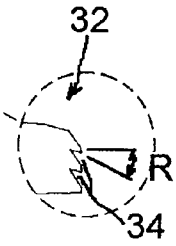

As shown, the retention ring 14 is an inwardly biased split ring with a single inner circumferential tooth 16 (FIG. 2*a*). The tooth 16 is undercut to provide a locking profile with a positive rake angle R. The retention ring 14 is housed within an internal recess profile 28 on a lockdown mechanism actuating mandrel 26. A collar 30 threaded into the top of the actuating mandrel 26 keeps the retention ring 14 within the recess profile 28.

2) Detent Pins

Upper 18 and lower 20 detent pins are distributed around the circumference of the tubing hanger 12. Each detent pin 18, 20 is securely retained within a hole extending radially through the tubing hanger upper body and comprises a ball bearing 22, 24 at its radially inner end. The length of each pin inclusive of the ball bearing is slightly greater than the thickness of the tubing hanger upper body in which it is housed, for reasons further explained below.

3) Complementary Locking Profile

This profile 32 comprises series of axially spaced, circumferential tooth grooves 34 on the outer surface of the tubing hanger upper body, between the upper 18 and lower 20 detent pins. It is made of sufficient axial length to accommodate the vertical tolerance stack of the actuating mandrel 26. Each groove 34 provides a mating profile for the retention ring tooth 16 and thus likewise is undercut to produce a positive rake angle R.

Operating Principle

Figure 1:
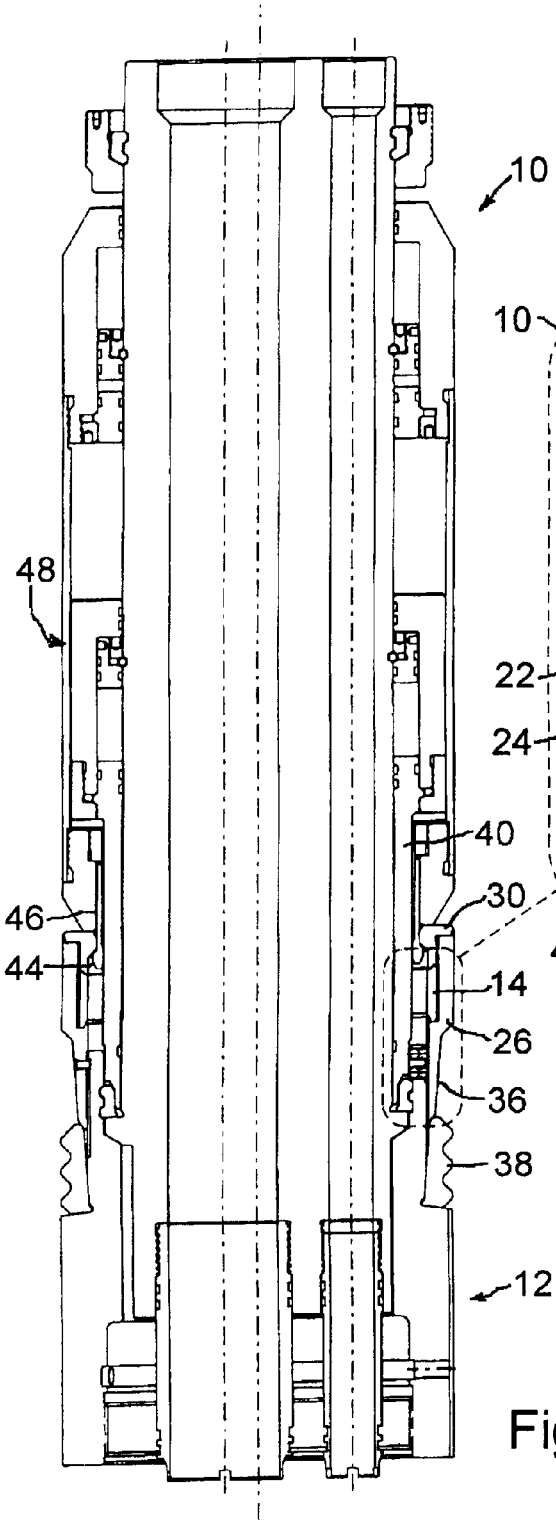
FIG. 1 shows a tubing hanger with a lockdown mechanism embodying the invention, the tubing hanger being latched onto a running tool ("THRT") and the lockdown mechanism being shown in an inactive (contracted) condition.

First, the tubing hanger lockdown mechanism is retracted ready for installation of the hanger in the wellhead. For this purpose, the actuating mandrel 26 is raised, substantially withdrawing its taper surface 36 from behind a lock ring 38, as shown in FIG. 1.

Then the THRT 10 is made up to the tubing hanger 12. During this process the THRT latch piston 40 is extended. The lower end of the piston 40 moves a latch ring 42 into a corresponding internal profile in the tubing hanger 12 upper body, to latch the tubing hanger 12 onto the running tool 10. The body of the latch piston 40 moves behind enlarged tips 44 of collet fingers 46, retaining them beneath a shoulder inside the actuating mandrel collar 30. In this way, the collar 30 is trapped between the finger tips 44 and the lower end of a tubing hanger setting piston assembly 48, from which the collet fingers 46 extend. The tubing hanger setting piston assembly is vertically movable with respect to the latch ring 42. The lockdown mechanism actuating mandrel is thereby rigidly connected for movement with the setting piston assembly 48, relative to the tubing hanger upper body.

The vertical movement of the latch piston 40 past the ball bearings 22, 24 causes outward radial displacement of the detent pins 18, 20, causing their rounded outer ends to sit proud of the tubing hanger upper body outside diameter.

Figures 3, 3A:
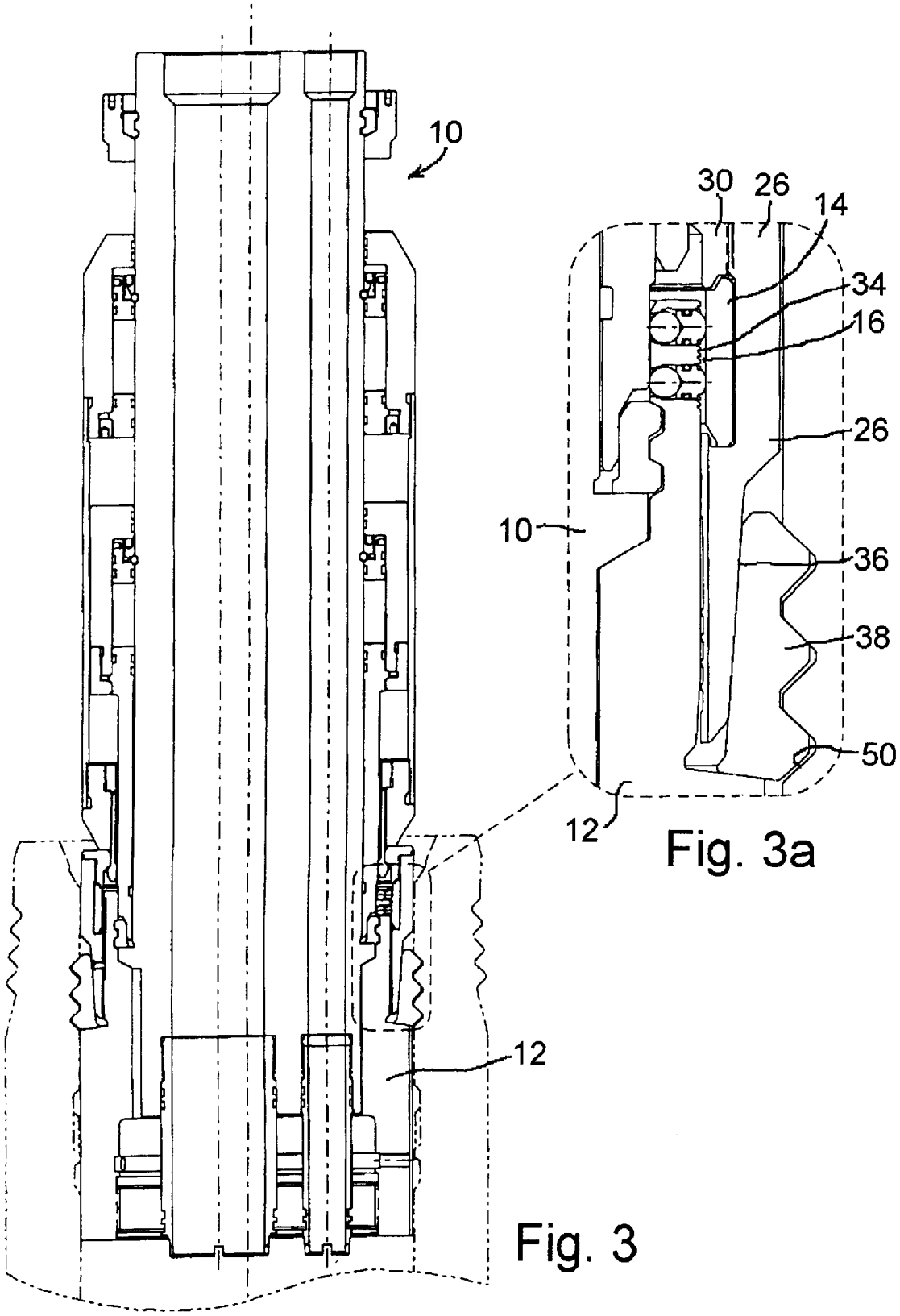
FIG. 3 shows the tubing hanger and THRT of FIG. 1 but with the lockdown mechanism activated (expanded)
FIG. 3*a* is an enlargement of a portion of FIG. 3.

The tubing hanger 12 and attached tubing (not shown) is then picked up, run in hole, landed and locked into the wellhead. During the process the THRT setting piston assembly 48 is extended. The vertical travel of the THRT setting piston assembly 48 moves the actuating mandrel 26 down, expanding the tubing hanger lock ring 38 into the wellhead profile 50 (FIG. 3*a*), securing the hanger. As the actuating mandrel 26 moves down, the protruding ends of the detent pins 22, 24 ride up a ramp surface 52 on the retention ring 14, causing it to expand into the retention groove profile 28. In this expanded condition, a radial clearance exists between the tooth 16 and the complementary locking profile 32. On completion of the setting sequence but prior to disconnection of the THRT from the tubing hanger (see FIGS. 3 and 3*a*), the retention ring tooth 16 will be opposite (or very close to), a retention groove 34 on the tubing hanger upper body, but will be held clear of the complementary locking profile 32.

Figure 4:
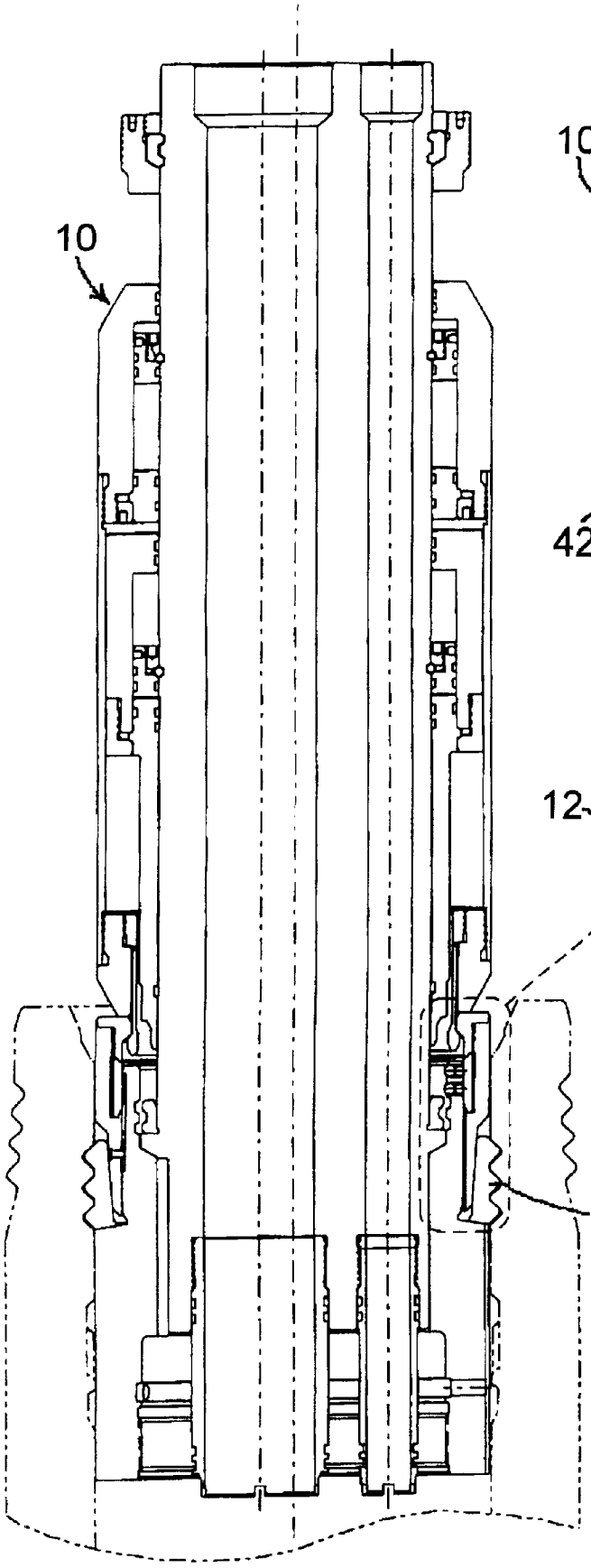
FIGS. 4 and 4*a* correspond to FIGS. 3 and 3*a*, but show the THRT latch disengaged from the tubing hanger and the anti-backout device positively engaging the lockdown mechanism.
Figure 4A:
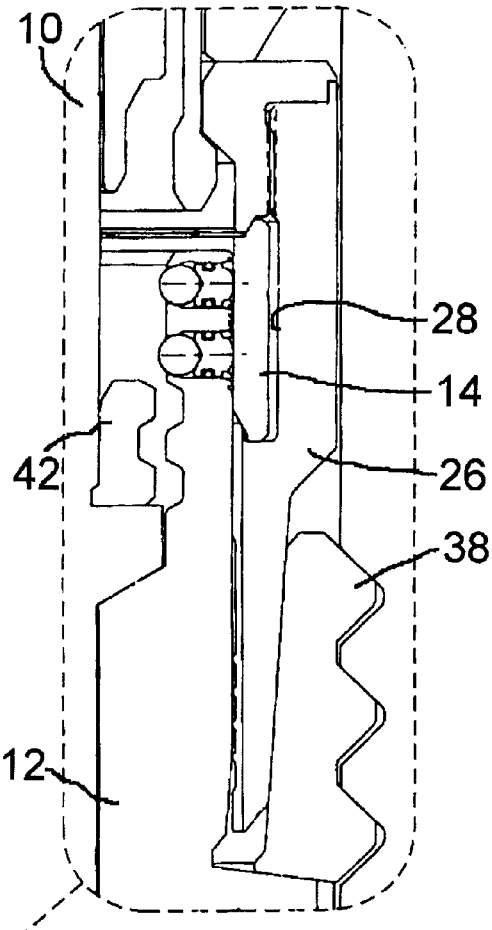

The THRT is next disengaged from the tubing hanger and retrieved to the surface. In the process the THRT latch piston 40 is retracted. The vertical movement of the piston 40 frees the pins 18, 20 for inward movement and allows the retention ring 14 to contract to its free state. The retraction of the retention ring 14 will engage the positive rake tooth 16 into one of the grooves 34 of the complementary locking profile 32. The actuating mandrel 26 is now positively retained on the tubing hanger 12 upper body (FIGS. 4 and 4*a*). Withdrawal of the latch piston 40 disengages the latch ring 42 from the tubing hanger 12 and allows the collet fingers to flex inwardly for disengagement from the collar 30.

Various modifications will be readily apparent. For example, the locking tooth 16 may be provided on the tubing hanger upper body, with the complementary locking profile on the retention ring 14. Additionally or alternatively, more than one locking tooth 16 may be provided. The retention ring 14 may be outwardly biased and housed in the tubing hanger upper body, with the complementary locking profile on the actuating mandrel 26. In that case the retention ring is held contracted out of engagement with the complementary locking profile, for example by bolts or bosses extending through the wall of the tubing hanger upper body and having heads engageable in vertically extending undercut camming grooves formed on the outside of the latch piston 40.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A completion component having a lockdown mechanism comprising:

an actuating mandrel provided with a taper surface;

a locking dog engageable with the taper surface for movement between contracted and expanded positions;

a locking member carried by the actuating mandrel or completion component and having a radially directed locking profile;

a radially directed complementary locking profile being provided on the completion component or actuating mandrel, the locking profile being radially biased into engagement with the complementary locking profile so as to restrain the actuating mandrel against axial movement relative to the completion component; and a running tool latch mechanism engageable with the locking member during installation of the completion component so as to move the locking profile and complementary locking profile out of engagement against said bias, whereby the actuating mandrel is free to move axially of the completion component.

2. A completion component as defined in claim 1, wherein the locking profile and complementary locking profile comprise teeth having a positive rake angle such that forces acting on the actuating mandrel in a direction tending to move the locking dog towards the contracted position also cause the locking profile and complementary locking profile to move into tighter engagement.

3. A completion component as defined in claim 1, wherein the locking profile and/or the complementary locking profile comprise(s) an axially spaced series of teeth.

4. A completion component as defined in claim 1, wherein the lockdown mechanism comprises a pin having a first end engageable by a latch piston of the running tool latch mechanism, and a second end arranged to move the locking member against said radial bias when the first end is so engaged.

5. A completion component as defined in claim 4, wherein the pin first end comprises a ball bearing.

6. A completion component as defined in claim 1, wherein the locking member comprises a split ring.

7. A completion component as defined in claim 6, wherein the split ring is radially inwardly biased and is carried in a groove formed in an axial bore of the actuating mandrel.

* * * * *